United States Patent [19]

Okano et al.

[11] Patent Number: 4,950,951

[45] Date of Patent: Aug. 21, 1990

[54] VENETIAN BLIND TYPE SECONDARY ELECTRON MULTIPLIER FOR SECONDARY ELECTRON MULTIPLIER TUBES

[75] Inventors: Kazuyoshi Okano; Kimitsugu Nakamura; Hiroyuki Kyushima, all of Shizuoka, Japan

[73] Assignee: Hamamatsu Photonics Kabushiki Kaisha, Shizuoka, Japan

[21] Appl. No.: 300,981

[22] Filed: Jan. 24, 1989

[30] Foreign Application Priority Data

Jan. 26, 1988 [JP] Japan ..... 63-15325

[51] Int. Cl.[5] ..... H01J 43/22

[52] U.S. Cl. ..... 313/535; 313/534; 313/533; 313/104; 313/105 R

[58] Field of Search ..... 313/535, 533, 104, 105 R

[56] References Cited

U.S. PATENT DOCUMENTS 4,184,098 1/1980 Morales ..... 313/535

FOREIGN PATENT DOCUMENTS 59-23609 6/1984 Japan .

59-25280 6/1984 Japan .

*Primary Examiner*—Kenneth Wieder

*Attorney, Agent, or Firm*—Finnegan, Henderson Farabow, Garrett, and Dunner

[57] ABSTRACT

A secondary electron multiplier having a Venetian blind dynode structure for use in a photomultiplier tube or the like. The dynode structure includes first and second dynodes being vertically disposed transverse to each other in that the geometrically transparent part of the first dynode is aligned with a portion of the geometrically opaque part of the second dynode corresponding to a width dimension defined from the lower end of the second dynode, and the voltages applied to the dynodes are specially configured to provide a sufficient energy to the dynodes for secondary electron mulitplication.

15 Claims, 2 Drawing Sheets

VENETIAN BLIND TYPE SECONDARY ELECTRON MULTIPLIER FOR SECONDARY ELECTRON MULTIPLIER TUBES

BACKGROUND OF THE INVENTION

1. Field of the Invention

The present invention relates to a secondary electron multiplier and more particularly to a secondary electron multiplier having a "Venetian blind" dynode structure for use in a photomultiplier tube or the like.

2. Description of the Prior Art

A Venetian blind dynode structure for multiplying secondary electrons is well known as a dynode arrangement of a secondary electron multiplier in the prior art. the applicant of the present invention disclosed an embodiment of such Venetian blind dynode structure in Japanese Examined Patent Publications No. 23609/1984 and No. 25280/1984.

In the Venetian blind dynode structure, the dynode structure includes a series of slats or vanes disposed at a slanting angle with respect to the direction of propagation of photoelectrons which have been emitted from a photoemissive surface of a photocathode or of secondary electrons which have been emitted from the preceding dynode stage.

FIG. 1 shows an enlarged cross sectional view of a typical example of such Venetian blind dynode structure of a secondary electron multiplier in the prior art. A first dynode 1 includes a pair of thin plates 11 and 12, each capable of emitting secondary electrons. A second dynode 2 includes a pair of thin plates 21 and 22, each also capable of emitting secondary electrons. Thin plate pairs 11 and 12, and 21 and 22, constituting respective first and second dynodes 1 and 2, are slanted at a 45 degree angle with respect to the longitudinal axis of a second electron multiplier tube. Mesh-electrodes 10 and 20 are kept at a same potential as first and second dynodes 1 and 2, respectively.

In FIG. 1, a character "d" refers to the width of a geometrically transparent portion of first dynode 1 in that propagation of the photoelectrons emitted from the photocathode is not hindered by first dynode 1. With "d" is also a free space or gap formed between thin plates 11 and 12, disposed in parallel to each other, constituting first dynode 1. The photoelectrons emitted from the photocathode propagate through this free space to reach second dynode 2.

In FIG. 1, a portion of a thin plate 22 constituting the second dynode 2 having an edge corresponding to an upper edge of thin plate 22 is vertically aligned with the geometrically transparent portions of the first dynode 1. The upper edge of corresponding thin plate 22 refers to one of two edges of thin plate 22, which is disposed relatively close to thin plate 12 constituting first dynode 1.

In FIG. 1, secondary electrons emitted from an upper portion of thin plate 12 constituting first dynode 1 bounce back to thin plate 12, as shown by arrows "a1" and "a2", and secondary electrons emitted from the central portion of thin plate 12 constituting first dynode 1 impinge on the back surface of another thin plate 11 constituting first dynode 1 due to an insufficient electric field, as shown by arrows "b1" and "b2". The upper portion of thin plate 12 refers to a portion of thin plate 12 which is disposed relatively far from thin plate 22 constituting second dynode 2.

Since these secondary electrons do not have a sufficient energy level to be multiplied, these secondary electrons do not contribute to the emission of secondary electrons in the secondary electron multiplier in the prior art. Moreover, the secondary electrons that pass through the geometrically transparent portion of the first dynode and impinge directly on the upper portion of the second dynode also can not be multiplied for the same reason. Therefore, the secondary electron multiplier in the prior art does not provide an efficient electron multiplication.

SUMMARY OF THE INVENTION

An object of the present invention is to provide a secondary electron multiplier with a dynode arrangement in which secondary electrons can be efficiently multiplied.

To attain the above object, a secondary electron multiplier according to this invention includes first and second dynodes of the Venetian blind dynode structure in that, (a) a portion of the second dynode having an edge corresponding to a lower edge of the second dynode is vertically aligned with a geometrically transparent part of the first dynode, so that photoelectrons emitted from a photocathode are passed through the geometrically transparent part of the first dynode to reach the second dynode, and (b) voltages applied to the first and second dynodes are configured to provide a relationship of $\delta 1 \cdot \delta 2 = \delta 2'$, where $\delta 1$ represents the secondary electron emission rate of the first dynode, $\delta 2$, the secondary electron emission rate of the second dynode when secondary electrons emitted from the first dynode impinge on the second dynode, and $\delta 2'$, the second electron emission rate of the second dynode when the secondary electrons passing through the geometrically transparent part of the first dynode impinges on the second dynode.

DESCRIPTION OF THE PREFERRED EMBODIMENT

The preferred embodiment of the invention will be described in detail with reference to the accompanying drawings. The following embodiment is described merely to promote the clear understanding of the present invention, and modifications thereof may be made by one skilled in the art without departing from the spirit and scope of the present invention.

According to an embodiment of the present invention, each of the thin plates constituting a dynode is a fully integrated single thin plate piece having at least one surface capable of emitting secondary electrons. Each thin plate is made out of an alloy of copper and beryllium. The alloy is heated in an oxygen atmosphere to form an oxidized thin layer on the surface of the alloy.

The secondary electron multiplier includes a secondary electron multiplier tube having at least two dynodes being vertically spaced from and disposed transverse to one another with respect to the longitudinal axis of the secondary electron multiplier tube. The secondary electron multiplier tube generally includes an electron source in that a photocathode, a series of dynodes, and a second-electron capturing electrode (collector) are disposed in a sequence in a vacuum container with respect to the longitudinal axis of the tube.

Voltages are applied to the dynodes to generate a sufficient electric field for accelerating secondary electrons at times when the secondary electron multiplier is operating. Secondary electrons emitted from the electron source impinge on the dynodes, and are multiplied at the time of each impingement. The multiplied secondary electrons are finally captured by the collector.

Each dynode in the secondary electron multiplier having the Venetian blind dynode structure includes rectangular thin plates. The longer side of each rectangular thin plate is disposed in a direction perpendicular to the longitudinal axis of the tube and the shorter side is at a slanting angle with respect to the longitudinal axis of the tube. All of the thin plates associated with the dynodes are slanted at a given angle with respect to the longitudinal direction of the tube. However, the thin plates corresponding to one of the adjacent dynodes are slanted at an opposing angle with respect to the thin plates corresponding to another of the adjacent dynodes. Generally, a mesh-electrode is provided in front of a dynode on which electrons impinge, and the mesh electrode is kept at a same potential as the dynode.

Figure 3:
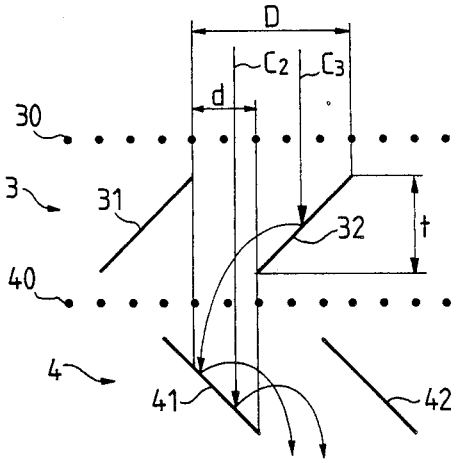
FIG. 3 is an enlarged cross sectional view of an embodiment of the Venetian blind dynode structure of a secondary electron multiplier according to the present invention.

FIG. 3 is an enlarged cross sectional view of an embodiment of a dynode arrangement of a secondary electron multiplier of the present invention shown with some electron trajectories. Thin plates 31 and 32 constitutes a first dynode 3 and are capable of multiplying secondary electrons.

In this embodiment, secondary electron multiplication is achieved by providing BeO on the surface of thin plates 31 and 32. BeO is formed by depositing Be on an alloy of copper and beryllium and subsequently oxidizing the alloy. A mesh-electrode 30 is kept at a same potential as thin plates 31 and 32. Similarly, thin plates 41 and 42 constitute a second dynode 4 and are capable of multiplying second electrons. Thin plates 41 and 42 are slanted at a same, but opposing angle as thin plates 31 and 32, with respect to the longitudinal axis of the tube. A mesh-electrode 40 is kept at a same potential as thin plates 41 and 42.

A portion of second dynode 4 corresponding to a width dimension "d" of the thin plate 41 of second dynode 4 is disposed vertically transverse to first dynode 3 and aligned with the distance or gap between thin plates 31 and 32 corresponding to the geometrically transparent part of the first dynode 3. Width dimension "d" is defined from an edge thereof corresponding to one of two edges of a geometrically opaque part of second dynode 4, which is disposed relatively close to first dynode 3.

A geometrically transparent part of a dynode is defined as a space in the dynode through which electrons pass without impinging on the dynode. A geometrically opaque part of the dynode is defined as a space in the dynode through which electrons impinge on the dynode. Width "d" also represents the width of the geometrically transparent part of first dynode 3 from a view point of the electron source.

In this arrangement of the secondary electron multiplier according to the present invention, photoelectrons passing through the geometrically transparent part of the first dynode impinge directly on the opaque part of the second dynode, thereby effectively converting the photoelectrons to secondary electrons.

Further, in this invention, voltages applied to the first and second dynodes are configured to give a relationship of:

$$\delta 1 \cdot \delta 2 = \delta 2',$$

where $\delta 1$ is the ratio between the number of photoelectrons impinging on the first dynode and the number of secondary electrons which are emitted from the first dynode in accordance with the incidence of the photoelectrons impinging on the second dynode, $\delta 2$ is the ratio between the number of secondary electrons emitted from the first dynode and subsequently impinging on the second dynode, and the number of secondary electrons emitted from the second dynode in accordance with the impinging on the second dynode and subsequently impinging on a third dynode, and $\delta 2'$ is the ratio between the number of secondary electrons passing through the first dynode without impinging on the first dynode and then impinging on the second dynode and the number of secondary electrons emitted from the second dynode in accordance with the impinging on the second dynode and subsequently impinging on a third dynode.

Figure 4:
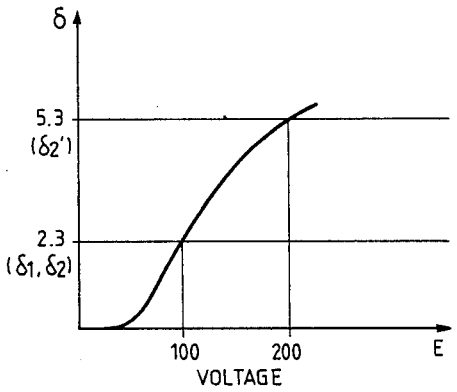
FIG. 4 is a graph showing a characteristic of secondary electron emission of thin plates constituting dynodes.

FIG. 4 is a graph showing a secondary electron emission characteristic of each one of a plurality of thin plates constituting a dynode. The abscissa and ordinate of the graph show the electron energy and secondary electron emission rates, respectively. When the potential difference between the photocathode and first dynode and also between the first and second dynodes is 100V, the photoelectrons impinging on the first dynode are multiplied by $\delta 1$ times, or 2.3 times, by the first dynode as shown in FIG. 4. Thereafter, the multiplied electrons are further multiplied $\delta 2$ times, or 2.3 times, by the second dynode as shown in FIG. 4. As a result, the incident photoelectrons are multiplied a total of $\delta 1 \cdot \delta 2 = 5.29$ times, as shown in FIG. 4.

As the electrons passing through the geometrically transparent part of the first dynode subsequently impinge directly on the geometrically opaque part of the second dynode and are multiplied $\delta 2'$ times, or 5.3 times, the multiplication rate associated with the first dynode is equal to that of the second dynode. In the third and subsequent dynodes, the electrons are multiplied also at the same rate as they reach each dynode. Therefore, the light photons) entering the photocathode is always outputted at the same intensity level. When the voltages applied to the dynodes are configured as described above, an optimal output pulse height distribution can be obtained and, as a result, a good signal to noise (S/N) ratio can be obtained.

Figure 1:
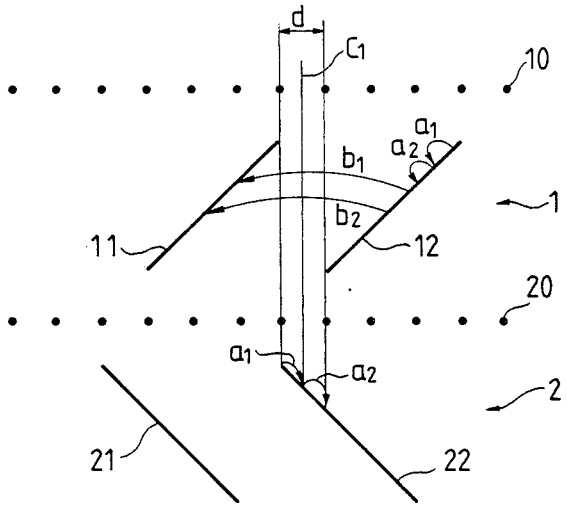
FIG. 1 PRIOR ART
FIG. 1 is an enlarged cross sectional view of an example of the Venetian blind dynode structure of a secondary electron multiplier in the prior art.
Figure 2:
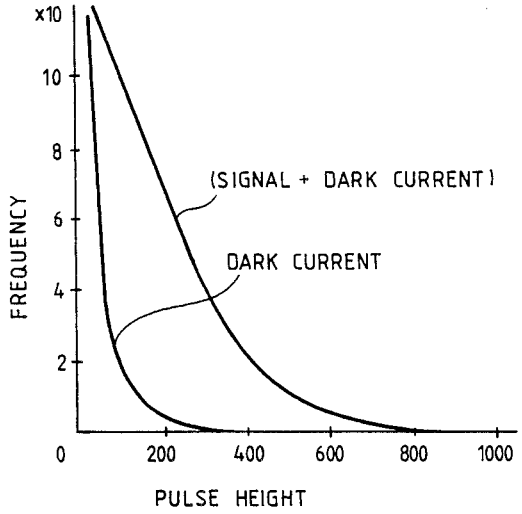
FIG. 2 PRIOR ART
FIG. 2 is a graph showing a pulse height distribution of secondary electron multiplication of the secondary electron multiplier of FIG. 1.
Figure 5:
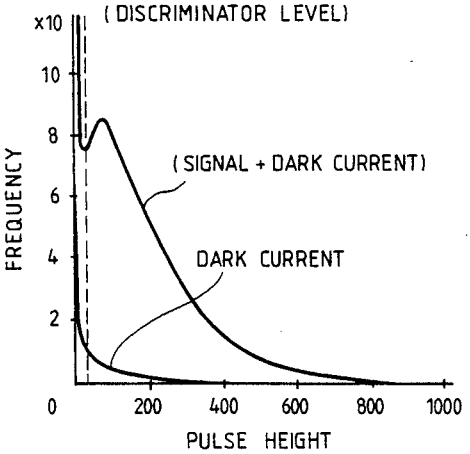
FIG. 5 is a graph showing a pulse height distribution of secondary electron multiplication of the secondary electron multiplier of FIG. 3.

The operation of obtaining optimal pulse height distributions of the secondary electron multiplier in the present invention is described hereinafter. Pulse height distribution curves corresponding to dark and signal currents, respectively of the present invention are shown in FIG. 5 and of the prior art are shown in FIG. 2. A pulse height distribution is defined as an output distribution of a secondary electron multiplier when a single photon is incident on a photocathode of the multiplier. It is illustrated by a graph having the abscissa representative of a pulse height (the number of electrons included in a group) and the ordinate of a corresponding frequency.

The pulse height distribution curve for the signal current according to the present invention has a peak and valley as shown in FIG. 5. More precisely, the valley has a significantly smaller pulse height than the peak. By setting a discriminator level for the pulse height equal to the pulse height of the valley shown in FIG. 5, the frequency range in which the dark current has a significant pulse height is easily distinguished from the range in which the signal current has a significant pulse height, so that the dark current pulses are effectively discriminated from the signal current pulses with little adverse effect thereon, thus significantly improving the S/N ratio.

In contrast, in the prior art, as shown in FIG. 2, it is extremely difficult to set an appropriate discriminator level in the pulse height distribution graph which can distinguish the frequency range in which the dark current having a significant pulse height from having a significant pulse height.

What is claimed is:

1. A secondary electron multiplier having a plural stage Venetian dynode assembly, comprising:

a first dynode having a first plurality of thin plates for receiving photoelectrons and emitting secondary electrons therefrom, each one of said thin plates being disposed substantially in parallel to one another and being spaced from one another to define a gap for passing part of the photoelectrons, and each thin plate having first and second edges opposite one another; and a second dynode being spaced vertically from said first dynode, said second dynode having a second plurality of thin plates, each one of said thin plates being disposed substantially in parallel to one another and having nearer and farther edges with respect to the first dynode, the first edge of each of the thin plates of the first dynode being nearer a midplane between the first and second dynodes than the second edge of each of the plates is to the midplane, wherein the farther edge of the thin plate of said second dynode is vertically aligned with the first edge of the respective thin plate of the first dynode such that said gap between a respective pair of said first plurality of thin plates of said first dynode is aligned with the portion of the thin plate of the second dynode which includes the farther edge thereof, wherein voltages are applied to said first and second dynodes to satisfy the following equation: $\delta 1 \cdot \delta 2 = \delta 2'$, where $\delta 1$ represents the secondary electron emission rate of the first dynode; $\delta 2$, the secondary electron emission rate of the second dynode when the electron emitted from the first dynode impinges on the second dynode; and $\delta 2'$, the secondary electron emission rate of the second dynode when the electron passing through the gap of said first dynode impinges on said second dynode.

2. The secondary electron multiplier as claimed in claim 1, wherein each of said first and second pluralities of thin plates is made of an alloy of copper and beryllium.

3. The secondary electron multiplier as claimed in claim 1, wherein beryllium oxide is deposited on at least one surface of each of said first and second pluralities of thin plates.

4. The secondary electron multiplier as claimed in claim 1, wherein said first and second pluralities of thin plates are slanted at an opposing angle to each other with respect to the longitudinal axis of said secondary electron multiplier tube.

5. The secondary electron multiplier as claimed in claim 1, wherein each of said first and second pluralities of thin plates is a rectangular metal piece.

6. A secondary electron multiplier having a plural stage Venetian dynode assembly, comprising:

a first dynode having a first plurality of thin plates for receiving photoelectrons and emitting secondary electrons therefrom, each one of said thin plates being disposed substantially in parallel to one another and being spaced from one another to define a gap for passing part of the photoelectrons; and a second dynode being spaced vertically from said first dynode, said second dynode having a second plurality of thin plates, each one of said thin plates being disposed substantially in parallel to one another, wherein voltages are applied to said first and second dynodes to satisfy the following equations: $\delta 1 \cdot \delta 2 = \delta 2'$, where $\delta 1$ represents the secondary electron emission rate of the first dynode; $\delta 2$, the secondary electron emission rate of the second dynode when the electron emitted from the first dynode impinges on the second dynode; and $\delta 2'$, the secondary electron emission rate of the second dynode when the electron passing through the gap of said first dynode impinges on said second dynode.

7. A secondary electron multiplier as claimed in claim 6, wherein each of said first and second pluralities of thin plates is made of an alloy of copper and beryllium.

8. A secondary electron multiplier as claimed in claim 6, wherein beryllium oxide is deposited on at least one surface of each of said first and second pluralities of this plates.

9. A secondary electron multiplier as claimed in claim 6, wherein said first and second pluralities of thin plates are slanted at an opposing angle to each other with respect to the longitudinal axis of said secondary electron multiplier tube.

10. A secondary electron multiplier as claimed in claim 6, wherein each of said first and second pluralities of thin plates is a rectangular metal piece.

11. A secondary electron multiplier having a plural stage Venetian dynode assembly, comprising:

a first dynode having a first plurality of thin plates for receiving photoelectrons and emitting secondary electrons therefrom, each one of said thin plates being disposed in parallel to one another and being spaced from one another to define a gap for passing part of the photoelectrons, and each thin plate having first and second edges opposite one another; and a second dynode being spaced vertically from said first dynode, said second dynode having a second plurality of thin plates, each one of said thin plates being disposed substantially in parallel to one another and having nearer and farther edges with respect to the first dynode, the first edge of each of the thin plates of the first dynode being nearer a midplane between the first and second dynodes than the second edge of each of the thin plates is to the midplane, wherein the farther edges of the thin plate of said second dynode is vertically aligned with the first edge of the respective thin plate off the first dynode such that said gap between a respective pair of said first plurality of thin plates of said first dynode is aligned with the portion of the thin plate of the second dynode which includes the farther edge thereof.

12. The secondary electron multiplier of claim 11, wherein each of said first and second pluralities of thin plates is made of an alloy of copper and beryllium.

13. The secondary electron multiplier of claim 11, wherein beryllium oxide is deposited on at least one surface of each of said first and second pluralities of thin plates.

14. The secondary electron multiplier of claim 11, wherein said first and second pluralities of thin plates are slanted at an opposing angle to each other with respect to the longitudinal axis of said secondary electron multiplier tube.

15. The secondary electron multiplier of claim 11, wherein each of said first and second pluralities of thin plates is a rectangular metal piece.

* * * * *